US006077642A

United States Patent [19]

Ogata et al.

[11] Patent Number: 6,077,642

[45] Date of Patent: Jun. 20, 2000

[54] RECORDING MATERIAL

[75] Inventors: Yasuhiro Ogata; Kazuyuki Koike; Shojiro Sano, all of Shizuoka-ken, Japan

[73] Assignee: Fuji Photo Film Co., Ltd., Kanagawa, Japan

[21] Appl. No.: 08/844,657

[22] Filed: Apr. 21, 1997

[30] Foreign Application Priority Data

Apr. 22, 1996 [JP] Japan ..... 8-100504
Aug. 16, 1996 [JP] Japan ..... 8-216478

[51] Int. Cl.[7] ..... G03C 1/52

[52] U.S. Cl. ..... 430/171; 430/157; 430/162; 430/163

[58] Field of Search ..... 430/171, 157, 430/162, 163

[56] References Cited

U.S. PATENT DOCUMENTS

| | | | |
|---|---|---|---|
| H568 | 1/1989 | Tanaka et al. | 525/71 |
| 5,219,929 | 6/1993 | Miyashita et al. | 525/57 |
| 5,254,450 | 10/1993 | Lacz et al. | 430/538 |
| 5,290,671 | 3/1994 | Thomas et al. | 430/512 |
| 5,466,519 | 11/1995 | Shirakura et al. | 428/323 |
| 5,576,152 | 11/1996 | Hodge et al. | 430/449 |
| 5,679,494 | 10/1997 | Minami et al. | 430/179 |
| 5,683,850 | 11/1997 | Matushita et al. | 430/171 |

FOREIGN PATENT DOCUMENTS

| | | | |
|---|---|---|---|
| 0 570 969 | 11/1993 | European Pat. Off. | G03C 1/79 |
| 0 570 975 A1 | 11/1993 | European Pat. Off. | G03C 7/388 |
| 0 648 603 | 4/1995 | European Pat. Off. | B23B 31/30 |
| 0 661 590 | 7/1995 | European Pat. Off. | G03C 1/79 |
| 2 059 614 | 4/1981 | United Kingdom | G03C 1/86 |
| 93/04399 | 3/1993 | WIPO | G03C 1/79 |

*Primary Examiner*—Maria Nuzzolillo
*Assistant Examiner*—Laura Weiner
*Attorney, Agent, or Firm*—Sughrue, Mion, Zinn, Macpeak & Seas, PLLC

[57] ABSTRACT

The present invention provides a recording material comprising a substrate and a recording layer thereon characterized in that the oxygen transmission rate of the substrate, as measured in accordance with Method B of JIS K 7126, is not greater than 50 cc/m$^2$/day. If necessary, a protective layer is formed on the recording layer. The substrate is composed of a sheet of base paper and a plastic film layer present at least on the side of the paper which faces a recording layer to be formed. The plastic film layer is appropriately selected from the group consisting of a polyester film, a polyvinylidene chloride film, a polycarbonate film, a polyvinylchloride film and a film of a random copolymer of ethylene and vinylalcohol. The recording material according to the present invention is excellent in the long-term preservation of images, fading resistance and light fastness.

6 Claims, 1 Drawing Sheet

RECORDING MATERIAL

BACKGROUND OF THE INVENTION

1. Field of the Invention

The present invention relates to a recording material, and more particularly relates to a recording material which is excellent in fading resistance and light fastness and therefore is capable of preserving an image for a long period of time.

2. Description of the Related Art

A recording material has drawbacks such that, when it is exposed to sunlight for a long time or displayed in a room for a long period of time, coloration of a non-image area and discoloration or fading of an image area of the recording material take place. There is a marked tendency that a heat-sensitive recording material such as a multicolor heat-sensitive recording material has such drawbacks.

Hitherto, various methods have been proposed in order to solve such problems, i.e., coloration of a non-image area and discoloration or fading of an image area, but no satisfactory solution has been found.

SUMMARY OF THE INVENTION

The object of the present invention is to solve the above-mentioned problems and to provide a recording material which is excellent in fading resistance and light fastness and therefore capable of preserving an image for a long period of time.

This objective can be achieved by a recording material comprising a substrate and a recording layer thereon characterized in that the oxygen transmission rate of the substrate, as measured in accordance with Method B of JIS K 7126, is not greater than 50 cc/m$^2$/day.

A preferred substrate is composed of a sheet of base paper and a plastic film layer present at least on the side of a recording layer to be formed on the paper. For example, the plastic film layer is selected from the group consisting of a polyester film, a polyvinylidene chloride film, a polycarbonate film, a polyvinylchloride film and a film of a random copolymer of ethylene and vinylalcohol. Particularly preferred is a film produced by a melt-coextrusion of an ethylene/vinylalcohol random copolymer and an olefinic resin.

Preferably, the ethylene/vinylalcohol random copolymer has an ethylene content in the range of 20 to 60 mole percent and a degree of saponification of not less than 90 mole percent. If necessary, a protective layer is formed on the recording layer.

In the present invention, the substrate can be used in a variety of recording materials. That is, the substrate can be laminated with a variety of recording layers, such as a silver halide photosensitive layer and a heat-sensitive recording layer, capable of producing a color such as yellow, magenta or cyan.

If the oxygen transmission rate of the substrate, as measured in accordance with Method B of JIS K 7126, is not greater than 50 cc/m$^2$/day, the amount of the oxygen, which passes through the substrate and reaches a recording layer, is remarkably reduced with the result that the degree of the oxidation of the ingredients contained in the recording layer is decreased thereby decreasing coloration of non-image areas and the discoloration or fading of images.

DESCRIPTION OF THE PREFERRED EMBODIMENTS

Figure 1:
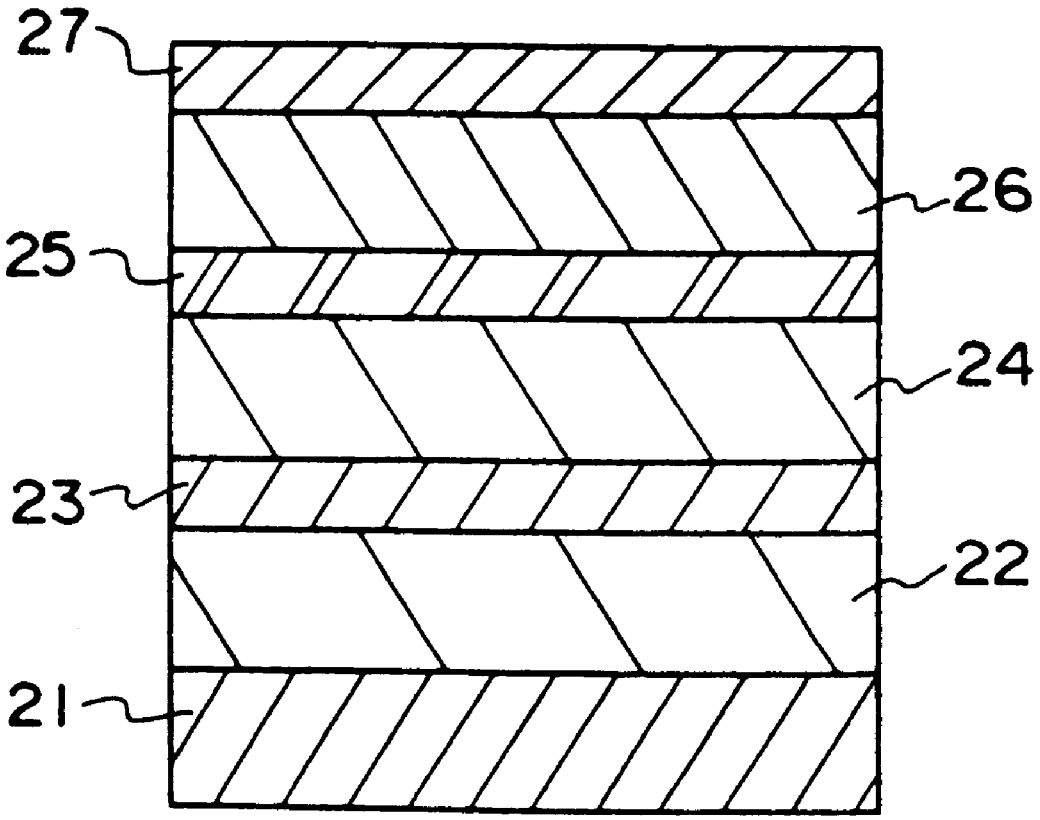
FIG. 1 is a sectional view of a multicolor heat-sensitive recording material as a preferred embodiment of the recording material of the present invention.

The base paper, which is used in the substrate of the recording material of the present invention, is selected from commonly employed materials; the main component of the paper is a natural pulp made from either soft-wood or hard-wood material. If necessary, the pulp is admixed with a filler, such as clay, talcum powder, $TiO_2$, $CaCO_3$ and fine particles of urea resin, a sizing agent, such as rosin, an alkylketene dimer, a higher fatty acid, an epoxidized fatty acid amide, a paraffin wax and an alkenyl succinate, a toughener, such as a polyacrylamide, starch and a polyamidepolyamine/epichlorohydrin adduct, or a fixing agent such as aluminum sulfate and a cationic polymer. In addition, a softener such as an epoxidized fatty acid amide and a surfactant may be added to the pulp. Alternatively, a synthetic pulp may be used in place of the natural pulp, or a mixture comprising a natural pulp and a synthetic pulp of a desired proportion may be used.

Although the type and thickness of the base paper is not particularly limited, it is preferable if the basis weight is between 40 and 200 g/m$^2$, and the surface of the paper is heat-treated under pressure by a calender, a soft calender or a super calender to provide a smooth and flat surface. An extremely flat surface is vital.

It is preferable if both sides of the base paper are coated with sizing agent. The sizing agent is an aqueous solution of polyvinylalcohol and/or a modified product thereof. Other components may be added to the sizing agent. E.g. starch, a polymer such as CMC, HEC, sodium alginate, gelatin, a metal salt such as calcium chloride, sodium chloride or sodium sulfate, a hygroscopic substance such as glycerine and polyethyleneglycol, a colorant or brightening agent such as a dye and a fluorescent brightening agent, a pH controlling agent such as sodium hydroxide, ammonia water, hydrochloric acid, sulfuric acid and sodium carbonate. Further, a softener such as an epoxidized fatty acid amide and a surfactant may be added to the sizing agent. If necessary, the sizing agent may further contain a pigment. A size press, a sizing tub or a gate roll coater is used to add and coat the above components to the paper.

The substrate for use in the recording material of the present invention comprises a sheet of base paper and a thermoplastic resin layer on both sides or at least on the side which faces the recording layer of the paper to be formed on the sheet. Examples of the substrate are (1) a sheet of base paper coated with a thermoplastic resin by melt-extruding the thermoplastic resin onto the paper; (2) a resin-coated paper made by a process of coating a sheet of base paper with a melt-extruded thermoplastic resin and then applying a gas-barrier layer to the thermoplastic resin layer to reduce oxygen transmission rate; (3) a resin-coated paper made by laminating to a sheet of base paper a plastic film having an oxygen transmission rate of not greater than 100 cc/m$^2$/day; (4) a resin-coated paper made by a process of laminating the plastic film to a sheet of base paper and then forming on the plastic film a thermoplastic resin layer by means of melt-extrusion; and (5) a resin-coated paper made by a process of coating a sheet of base paper with a thermoplastic resin by melt-extrusion and then laminating the plastic film to the thermoplastic resin layer.

Preferred examples of the thermoplastic resin, which is to be melt-extruded onto the base paper, are an olefinic resin exemplified by a homopolymer of an $\alpha$-olefin such as polyethylene or polypropylene, a mixture of these polymers or an ethylene/vinylalcohol random copolymer. Although the thickness of the melt-extruded thermoplastic resin on the paper is not particularly specified, it is preferred to be in the range of 10 to 60 μm.

However, in the case where polyethylene resins such as LDPE(low-density polyethylene), HDPE(high-density polyethylene) and L-LDPE(linear low-density polyethylene), are used (whether singularly or plurally), the thermoplastic resin needs to be overcoated with a gas-barrier layer due to the thermoplastic resin layer's high oxygen transmission rate.

A substrate having a low oxygen transmission rate can be obtained if a thermoplastic resin made by blending or melt-coextruding any of the above-mentioned polyethylene resins with an ethylene/vinylalcohol random copolymer is coated onto paper. When a plastic film with an oxygen transmission rate of less than 100 $cc/m^2/day$ is bonded (laminated) onto paper, a plastic film such as polyester film, a polyvinylidene chloride film, a polycarbonate film, a polyvinylchloride film and a film of a random copolymer of ethylene and vinylalcohol is preferred. The films with the lowest oxygen transmission rates such as polyethylene terephthalate film in the case of polyester films and a random copolymer of ethylene and vinylalcohol in the case of the other films are most preferable.

Preferably, the ethylene/vinylalcohol random copolymer has an ethylene content in the range of 20 to 60 mole percent, more preferably in the range of 25 to 50 mole percent, and a degree of saponification of not less than 90 mole percent, more preferably of not less than 95 mole percent.

If the ethylene content of the copolymer is less than 20 mole percent, the thermoforming of the film is difficult because the film forming temperature is close to the decomposition temperature of the copolymer, whereas if the ethylene content is more than 60 mole percent, the oxygen transmission rate of the film increases so that it is difficult to adjust the oxygen transmission rate to a value below a predetermined value. Furthermore, if the saponification value is less than 90 mole percent, the oxygen transmission rate of the film increases so that it is difficult to adjust the oxygen transmission rate to a value below a predetermined value. It is preferable if the plastic film is between 8 and 60 μm thick.

Any film forming methods for the above plastics, such as casting, extrusion, calendering and stretching, can be employed. They are all outlined in "Processing and Application of Plastic Films" by Plastic Film Study Conference (published by Gihodo Publishing Co., Ltd.).

Further, a white pigment may be incorporated into the plastic film. For example, titanium dioxide, barium sulfate, calcium carbonate and zinc oxide. These pigments may be used alone or in a combination of two or more of them. The amount of white pigment added is normally within the range of 5 to 20%, although the amount varies depending on the pigment and the plastic film.

In order to avoid dust contamination or to prevent failures due to electrostatic charge of the plastic film in subsequent steps, an antistatic layer may be formed on the surface of the plastic film surface. The antistatic layer is formed with an ionic organo-antistatic agent including an alkali metal salt of a polymeric carboxylic acid or an electronconductive antistatic agent such as tin oxide.

As for the method of laminating the plastic film to the base paper in the practice of the present invention, an appropriate method may be selected from known laminating methods described, for example, in "Handbook of New Lamination Processing" edited by "Processing Technique Research Association". Preferably, the laminating method to be employed is a so-called dry lamination, a non-solvent dry lamination or a dry lamination by use of an electron beam or ultraviolet ray curable resin, or a hot lamination. Dry lamination or solvent-free dry lamination is most preferably employed.

The dry lamination process involves applying an adhesive to a plastic film, drying the coated adhesive and pressing the plastic film onto a sheet of base paper under pressure at about 100° C. In this case, examples of the adhesive include solvent-based urethane resins, vinyl resins, acrylic resins, polyamide resins, epoxy resins and rubbers, and the coating weight of the adhesive is in the range of 5 to 15 $g/m^2$.

The solvent-free dry lamination process involves applying a reactive curable type adhesive such as a one-component moisture-curable urethane adhesive or a two-component urethane adhesive, at a coating weight in the range of 0.8 to 2.0 $g/m^2$, laminating the plastic film onto a sheet of base paper and then allowing the adhesive to cure with time to obtain a strong bond between the plastic film and the paper.

In the present invention, the resin layer is formed on the front surface of the substrate, where a recording layer is formed. Therefore, the resin layer may be formed on both sides of the substrate or only on the surface of the substrate on which the recording layer is formed. The resin layer on the front surface on which the recording layer is present, preferably contains a white pigment. The kind, and amount to be added etc. of the white pigment may be determined by reference to known techniques.

The resins, which constitute the plastic film, may be admixed with a known additive such as a fluorescent brightening agent or an anti-oxidant. Examples of the white pigment include titanium dioxide, barium sulfate, barium carbonate, calcium carbonate, lithopone, alumina, zinc oxide, silica, antimony trioxide and titanium phosphate. These pigments may be used alone or in a combination of two or more. Among these pigments, titanium dioxide and zinc oxide are preferred from the viewpoint of whiteness, dispersibility and stability.

Titanium dioxide may be of a rutile type or of an anatase type. These types may be used alone or in a combination. The titanium dioxide may be produced by a sulfuric acid process or by a hydrochloric acid process. Titanium dioxide may be a surface-treated one. For example, titanium dioxide may be surface-treated with an inorganic substance such as hydrated alumina, hydrated silicon dioxide and zinc oxide, surface-treated with an organic substance such as trimethylolmethane, trimethylolethane, trimethylolpropane or 2,4-dihydroxy-2-methylpentane, or surface-treated with a siloxane such as a polydimethylsiloxane. The loading amount of the white pigment in the plastic film is normally within the range of 5 to 20% by weight, although the amount varies depending on the kind of the white pigment and on the thickness of the resin layer.

The extrusion-coating machine, which is used for coating the paper with a thermoplastic resin such as a polyolefin by way of extrusion coating, is an ordinary extruder and laminator for a polyolefin. Preferably, the thickness of the resin layer on the surface of base paper (the front surface), on which the recording layer is formed, is larger than the thickness of the resin layer on the surface of the base paper (the back surface) on which the recording layer is not formed.

Prior to extruding-coating a resin layer onto the base paper, the paper is preferably pre-treated in order to strengthen the adhesion between the paper and the resin coating layer. Examples of the pre-treatment include an acid-etching treatment by use of a sulfuric acid/chromic acid mixture, flame treatment by means of a gas flame, a UV irradiation, a corona discharge, a glow discharge, application of an anchor coating such as alkyl titanate. The pre-treatment may be appropriately selected from these pre-treatments. Because of the simplicity of the treatment, a corona discharge treatment is preferred. In the case of the corona discharge treatment, it is necessary that the contact angle to water become not greater than 70°.

Examples of known anchor coating agents include organo-titanium compounds, isocyanates (urethanes), polyethylene imines and polybutadienes. More specifically, examples of the organo-titanium compounds include an alkyl titanate such as tetraisopropyl titanate, tetrabutyl titanate and tetrastearyl titanate, a titanium acylate such as butoxytitanium stearate, and a titanium chelate such as titanium acetylacetate. Examples of the isocyanates (urethanes) include toluene diisocyanate (TDI), diphenylmethane diisocyante (MDI), hexamethylene diisocyanate (HMDI), xylylene diisocyanate (XDI) and isophorone diisocyante (IPDI).

In order to enhance the adhesiveness between the resin layer such as a polyolefin layer, and a recording layer, which is formed on the resin layer, the resin layer may be surface-treated, for example by means of a corona discharge. The resin layer may be coated with an undercoat mainly composed of gelatin after the corona-discharge surface treatment.

The thermoplastic resin layer such as a polyethylene layer, on the base paper on a side that is opposite to the side on which a recording layer is to be formed, i.e., on the back side of the paper, normally has a mat surface. If necessary, an anti-static layer, containing an ionic organo-antistatic agent, such as an alkali metal salt of a polymeric carboxylic acid or colloidal silica, may be formed on the thermoplastic resin layer, such as a polyethylene layer, on the reverse side of the paper.

The substrate in the present invention is prepared in the above-described way. The substrate needs to have an oxygen transmission rate of not greater than 50 cc/m$^2$/day, as measured in accordance with Method B of JIS K 7126. According to JIS K 7126, the gas transmission rate (GTR) means the volume of a gas passing through a unit area of a sample sheet at a unit partial pressure difference in a unit time and is expressed as an oxygen transmission rate ($O^2$ GTR) if the gas is oxygen. The oxygen transmission rate is measured by Method B (equi-pressure method) of JIS K 7126, which is used only for the measurement of the oxygen transmission rate, wherein oxygen is fed to one side of a sample sheet while a nitrogen carrier gas is fed to the other side of the sample sheet at an identical pressure so that the amount of permeated oxygen is measured by means of an oxygen detector.

The oxygen transmission rate is calculated by the following equation.

$$O^2GTR = \frac{(E_e - E_o) \times Q}{A \times R} \quad (1)$$

where $O^2$ GTR: oxygen transmission rate (mole/m$^2$·s·Pa);

$E_e$: measured voltage(V);

$E_o$: base line voltage(V);

Q: calibration constant;

A: transmission area (m$^2$);

R: load resistance(Ω)

If the oxygen transmission rate is to be expressed in a conventional unit (cm$^3$/m$^2$·24 h·atm), the rate is calculated by the following equation.

$$O^2GTR = \frac{(E_e - E_o) \times Q}{A \times R} \quad (2)$$

where $O^2$ GTR: oxygen transmission rate (cm$^3$/m$^2$·24 h·atm);

$E_e$: measured voltage(V);

$E_o$: base line voltage(V);

Q: calibration constant;

A: transmission area (cm$^2$);

R: load resistance(Ω)

In the present invention, the oxygen transmission rate means a value calculated according to the equation (2). A smaller value of the oxygen transmission rate of the substrate is desired, and, if the oxygen transmission rate of the substrate is 50 cc/m$^2$/day (50 cm$^3$/m$^2$·24 h·atm) or less, it is possible to maintain a practical level of image preservation, fading resistance and light fastness for a long period of time.

A recording material excellent in the uniformity of the image can be obtained by coating a recording layer, which is described below, onto a sheet-shaped substrate obtained in the previously described manner. Next, a heat-sensitive recording layer, which constitutes the recording layer of the recording material, will be explained.

FIG. 1 illustrates a multicolor recording material made by consecutively layering, on one side of a sheet-shaped substrate 21, a transparent cyan heat-sensitive layer 22, an intermediate layer 23, a transparent yellow heat-sensitive layer 24, an intermediate layer 25, a transparent magenta heat-sensitive layer 26 and a transparent protective layer 27 in this order. In this case, at least the magenta heat-sensitive layer and the yellow heat-sensitive layer has a coloration system containing a diazo compound, while the cyan heat-sensitive layer may or may not have a coloration system containing a diazo compound. The diazo compounds are positioned in such a manner that the diazo compounds which are further from the substrate have higher decomposition wavelengths than the decomposition wavelengths of the diazo compounds that are closer to the substrate.

When recording is effected, first, an image in the outermost heat-sensitive layer becomes magenta by applying a low-level thermal energy to the outermost heat-sensitive layer and then the image is fixed by decomposing the diazo compound contained in the outermost heat-sensitive layer by irradiating the outermost layer from above thereof with light in the decomposition wavelength region.

Next, an image in the second heat-sensitive layer is colored in yellow by applying a higher-level thermal energy than the energy used in the above-described image recording to the second heat-sensitive layer and then the image is fixed by irradiating the second layer with light in the decomposition wavelength region of the diazo compound contained in the second layer. Further, the inner most heat-sensitive layer is colored in cyan by applying a further higher-level thermal energy than the energy used for the image recording in the second layer to the innermost heat-sensitive layer. In the case where a diazo compound is also used as a coloration system in the innermost layer, it is preferred that the recorded image in the innermost heat-sensitive layer be also fixed by irradiating the innermost layer with light in the decomposition wavelength region of the diazo compound contained in the innermost layer in order to prevent staining of the non-image area over time.

As explained above, cyan, magenta and yellow colorations can be performed independently. The seven primary colors: cyan, magenta, yellow, cyan+magenta (blue), magenta+yellow (red), cyan+yellow (green) and cyan+magenta+yellow (black) can be obtained with high color separation although such colorations were difficult hitherto. Those skilled in the art will be able to understand that the innermost heat-sensitive layer, even if it is not transparent, does not adversely affect the color reproduction.

Naturally, the transparent protective layer is not necessary, if the outermost heat-sensitive layer has a sufficient scratch resistance and sticking resistance. It can be seen that increasing the number of colors to be obtained can be synergistically increased by color mixing through the control of the coloration of each of the units by properly adjusting the thermal energy to be applied.

As stated above, the coloration system of the innermost layer does not need to utilize a diazo compound. In this case, a coloration system other than the use of the diazo compound is preferably a combination (a leuco system) composed of a precursor of an electron-donating dye and a developer, because of thermal sensitivity and color intensity.

Next, the constituents of the multicolor heat-sensitive recording material are explained in detail.

An electron donating dye, which donates electrons or accepts protons from acids to develop a color, is not specified here, but in the present invention, the electron donating dye is a compound which is normally colorless and which comprises a partial structure, such as lactone, lactam, sultone, spiropyran, ester or amide. When this compound is brought into contact with a developer, the above-mentioned partial structure undergoes a ring-opening or cleavage reaction. Examples of the dye include crystal violet lactone, benzoyl leucomethylene blue, Malachite green lactone, Rhodamine B lactam and 1,3,3-trimethyl-6'-ethyl-8'-butoxyindolinobenzospiropyran.

A developer, which is used in combination with the above-mentioned color former, is appropriately chosen from known developers. Examples of the developer for a leuco dye include a phenol-based compound, a sulfur-containing phenol-based compound, a carboxylic acid-based compound, a sulfone-based compound, a urea-based compound and a thiourea-based compound. The details are described in "Paper and Pulp Technical Times" (1985) pp 49–54, 65–70. Among these developers, particularly preferred are those having a melting point in the range of 50 to 250° C., specifically phenols and organic acids which have a melting point in the range of 60 to 200° C. and which are not very soluble in water. A combination of two or more developers is preferred because such a combination can enhance solubility.

Particularly preferred developers are represented by the following formulas (1)–(4):

General Formula (1)

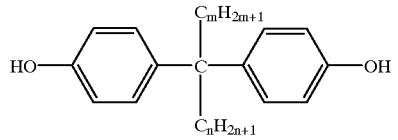

where m=0–2 and n=2–11.

General Formula (2)

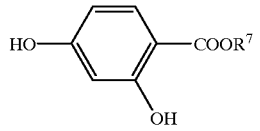

where $R^7$ is selected from the group consisting of alkyl, aryl, aryloxyalkyl and aralkyl groups, preferably methyl or butyl.

General Formula (3)

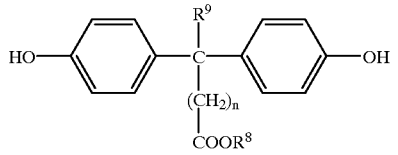

where $R^8$ is an alkyl group and is particularly selected from the group consisting of butyl, pentyl, heptyl and octyl groups. $R^9$ is hydrogen or methyl, and n is 0–2.

General Formula (4)

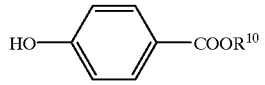

where $R^{10}$ is selected from the group consisting of alkyl, aralkyl and aryloxyalkyl groups.

The amount of developer used ranges from 0.3 to 160 parts by weight, or even better, from 0.3 to 80 parts by weight, based on one part by weight of the electron donating dye precursor.

Another color former that can be used for the multicolor heat-sensitive recording material is a diazo compound which develops a desired color as a result of reaction with a developer called a coupler, which is described hereinbelow. However, if the diazo compound is irradiated with light having a particular wavelength prior to the above-mentioned reaction, the diazo compound becomes incapable of developing a color even if the coupler acts on the diazo compound.

The color hue, which is developed in the above-mentioned color forming system, is determined mainly by the diazo dye which is formed by the reaction between the diazo compound and the coupler. Accordingly, as is well known, the developed color can be easily changed either by changing the chemical structure of the diazo compound or by changing the chemical structure of the coupler, and almost any color can be developed by a suitable combination of the diazo compound and the coupler.

A photo-decomposable diazo compound mainly means an aromatic diazo compound, and more specifically means such compounds as aromatic diazonium salts, diazosulfonates and diazo amino compounds. Diazonium salts are mainly explained below as an example of the diazo compound.

Generally, the photo-decomposition wavelength of a diazonium salt is said to be the peak absorption wavelength. The peak absorption wavelength of a diazonium salt is known to vary from about 200 nm to about 700 nm depending on the chemical structure (see "Photo-decomposition and Chemical Structure of Photosensitive Diazonium Salts" by T. Kakuta et al., Journal of the Photographic Society of Japan vol.29 (1965), No. 4, pp 197–205). Further, it is possible to change the color of the dye, which results from a coupling reaction, by changing the chemical structure of the diazonium salt even if an identical coupler is used for the coupling reaction.

A diazonium salt is a compound represented by a general formula $ArN_2^+X^-$. In the formula, Ar indicates a substituted or unsubstituted aromatic moiety, $N_2^+$ indicates a diazonium group and $X^-$ indicates an acid anion.

Examples of the above-mentioned compound having a photo-decomposable wavelength of about 400 nm include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-dibutoxybenzene, 4-diazo-1-anilinobenzene, 4-diazo-1-tolylmercapto-2,5-diethoxybenzene and 4-diazo-1,4-methoxybenzoylamino-2,5-diethoxybenzene.

Examples of the above-mentioned compound having a photo-decomposable wavelength in the range of 300 to 370 nm include 1-diazo-4-(N,N-dioctylcarbamoyl)benzene, 1-diazo-2-octadecyloxybenzene, 1-diazo-4-(4-tert-octylphenoxy)benzene, 1-diazo-4-(2,4-di-tert-aminophenoxy)benzene, 1-diazo-2-(4-tert-octylphenoxy) benzene, 1-diazo-5-chloro-2-(4-tert-octylphenoxy)benzene, 1-diazo-2,5-bis-octadecyloxybenzene, 1-diazo-2,4-bis-octadecyloxybenzene and 1-diazo-4-(N-octyltauroylamino) benzene. Any of these aromatic diazonium compounds can be used to alter the photo-decomposition wavelength in a broad range by appropriate modification of the substituents.

Concrete examples of the acid anion are represented by $C_nF_{2n+1}COO^-$ (n=3–9), $C_mF_{2m+1}SO_3^-$ (m=2–8) and $(ClF_{2i+1}SO_2)_2CH^-$ (i=1–18),

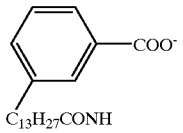

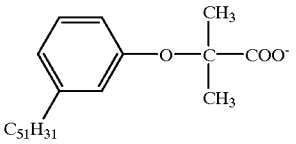

-continued

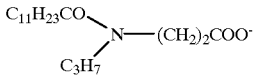

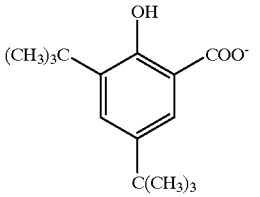

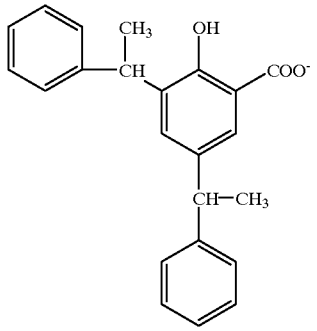

Concrete examples of the diazo compound (diazonium salt) are represented by the following formulas:

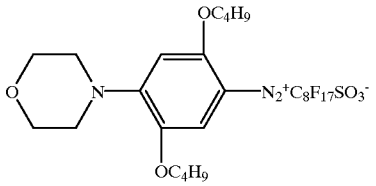

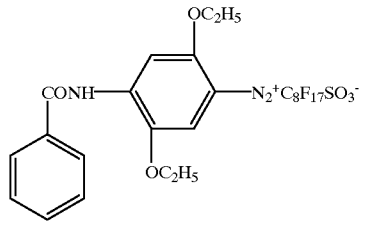

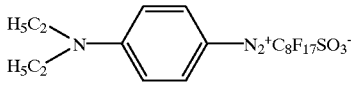

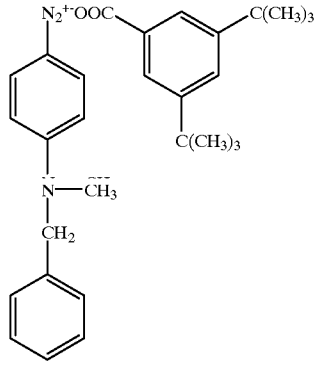

-continued

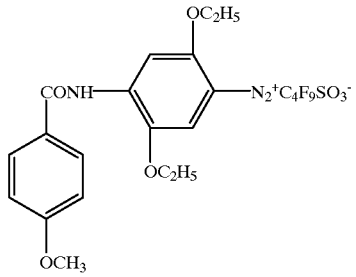

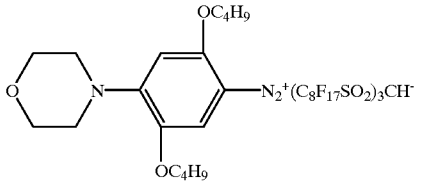

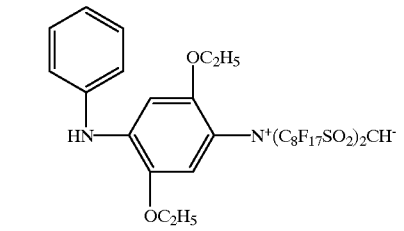

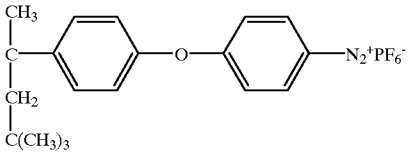

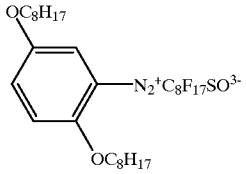

A diazo sulfonate usable in the present invention is a compound represented by the general formula:

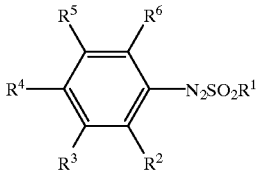

where $R_1$ is an alkali metal or an ammonium compound, and $R_2$, $R_3$, $R_5$ and $R_6$ are hydrogen, halogen, alkyl or alkoxyl, and $R_4$ is selected from the group consisting of hydrogen, halogen, alkyl, amino, benzoylaminde, morpholino, trimercapto and pyridino groups.

Many of these diazo sulfonates are known and they are produced by treating a corresponding diazonium salt with sulfites.

Among the above-mentioned compounds, preferred are benzenediazosulfonic acid salts having such substitutents as 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy and 4-acetamide. Also preferred are benzenediazosulfonic acid salts having such substitutents as 4-(N-ethyl, N-benzylamino), 4-(N,N-dimethylamino), 4-(N,N-diethylamino), 4-(N,N-diethylamino)-3-chloro, 4-pyrrolidino-3-chloro, 4-morpholino-2-methoxy, 4-(4'-methoxybenzoylamino)-2,5-butoxy and 4-(4'-trimercapto)-2,5-dimethoxy. When these diazo sulfonates are used, it is prefarable that they be irradiated with light prior to printing in order to activate them.

Other diazo compounds that are usable in the present invention are diazoamino compounds, which are produced by coupling a diazo group with a compound such as dicyandiamide, sarcosine, methyltaurine, N-ethylanthranic acid-5-sulfonic acid, monoethanol amine, diethanol amine or guanidine.

A coupler usable in the present invention is a compound which undergoes coupling with a diazo compound (diazonium salt) to form a dye. Examples of the coupler include resorcin, fluoroglucin, 2-3-hydroxynaphthalene-6-sulfonic acid sodium salt, 1-hydroxy-2-naphthoic acid morpholinopropylamide, 1,5-dihydroxynaphthalene, 2,3-dihydroxynaphthalene, 2,3-dihydroxy-6-sulfanilnaphthalene, 2-hydroxy-3-naphthoic acid morpholinopropylamide, 2-hydroxy-3-naphthoic acid-2'-methylamide, 2-hydroxy-3-naphthoic acid ethanolamide, 2-hydroxy-3-naphthoic acid octylamide, 2-hydroxy-3-naphthoic acid-N-dodecyl-oxy-propylamide, 2-hydroxy-3-naphthoic acid tetradodecylamide, acetanilide, acetoacetanilide, benzoylacetanilide, 1-phenyl-3-methyl-5-pyrazolone, 2,4-bis(benzoylacetoamino)toluene, 1,3-bis(pivaloylacetoaminomethyl)benzene, 1-(2'-4'-6'-trichlorophenyl)-3-benzamido-5-pyrazolone, 1-(2'-4'-6'-trichlorophenyl)-3-anilino-5-pyrazolone and 1-phenyl-3-phenylacetamido-5-pyrazolone.

A combination of two or more of these couplers can be used to produce an image of any desired color. Since the coupling reaction between the diazo compound and the coupler easily occurs in a basic environment, a basic substance may be incorporated into the layer.

Alkalines barely soluble or insoluble in water and a compound which generates an alkali on heating can be used. Examples of the basic substance include inorganic or organic ammonium salts, organoamines, amides, urea, thiourea and derivatives thereof, and nitrogen-containing compounds such as thiazoles, pyrroles, pyrimidines, piperazines, guanidine, indoles, imidazoles, imidazolines, triazoles, morpholines, piperidines, amidines, formazines and pyridines.

Examples of the basic substance are described, for example, in Japanese Patent Application (Laid-Open) No. 60-132,990. A combination of two or more of the basic substances may be used. Preferably, the amount of coupler used ranges from 0.1 to 10 parts by weight and the basic substance used ranges from 0.1 to 20 parts by weight based on one part by weight of the diazo compound.

It is preferred that part of the components of the above-mentioned reactive color formers be encapsulated. This enhances the transparency of the heat-sensitive layer, increases storage stability before use and avoids fogging by preventing contact between the color former and the developer at ordinary temperatures. It also controls the coloring sensitivity so that the color is developed by applying a desired amount of thermal energy.

Although the type of the microcapsule is not especially determined, the desired function of the microcapsule is to keep the substances inside and outside the capsule separate until the wall of the capsule is rendered permeable during any rise above a pre-fixed temperature. The temperature at which the permeation starts can be controlled at will by selection of the capsule wall's composition. In this case, the temperature at which the permeation starts corresponds to the glass transition temperature of the capsule wall (see, Japanese Patent Application Laid-Open (JP-A) Nos. 59-91, 438, 59-190,886 and 59-99,490).

In order to control the glass transition temperature, which is specific to the wall of the capsule, it is necessary to change the composition of the capsule wall. Examples of the material forming the wall include polyurethane, polyurea, polyester, polycarbonate, urea-formaldehyde resins, melamine resins, polystyrene, styrene/methacrylate copolymers, styrene/acrylate copolymers, gelatin, polyvinylpyrrolidone and polyvinylalcohol. In the present invention, a combination of two or more of these polymers may be used. In the present invention, polyurethane, polyurea, polyamide, polyester and polycarbonate are preferred for the wall. Particularly preferred are polyurethane and polyurea.

A preferred process for making the microcapsule comprises emulsifying a core substance containing a reactive substance such as a color former and then forming a wall consisting of a polymeric material to encapsulate the oil drop, wherein a reactant, which forms the polymeric material, is added to the inside/and or outside of the oil drop. Details of a good process for making the microcapsule for use in the present invention are described, for example, in Japanese Patent Application Laid-Open (JP-A) No. 59-222, 716.

The organic solvent to be used for the formation of the oil drop may be selected from organic solvents having a high boiling point. However, if an organic solvent is employed which is explained hereinbelow, and which is particularly suitable for dissolving the developer and coupler, apparent advantages are an excellent solubility for a color former, increased color intensity and coloring speed and decreased fog formation at the time of thermal printing. The microcapsule may be formed from an emulsion containing 0.2% by weight or more of a component to be encapsulated.

Unlike the microcapsules which are employed in a conventional recording material and which are destroyed by heat or pressure, the preferred microcapsule, which is produced in the above-described way, enables the reactive substances present outside and inside the microcapsule to pass through the wall of the microcapsule to cause a reaction.

A color-forming aid may be incorporated into the heat-sensitive layer. The color-forming aid increases the color intensity or decreases the lowest possible coloration temperature at the time of thermal printing. The color-forming aid is used in order to lower the melting temperature of such materials as couplers, basic substances, color formers, developers and diazo compounds or to lower the softening point of the wall of the capsule so that a condition is created where the diazo compounds, basic compounds, couplers, color formers, developers and the like are easily reacted.

Examples of the color-forming aid are a phenol, an alcohol, an amide, a sulfonamide and the like. Concrete examples include p-tert-octyl phenol, p-benzyloxyphenol, phenyl p-oxybenzoate, benzyl carbanilate, phenetyl carbanilate, hydroquinone dihyroxyethyl ether, xylylene diol, N-hydroxyethylmethane sulfonic acid amide and N-phenylmethane sulfonic acid amide. These substances may be incorporated in core substances or may be added in the form of an emulsion to the outside of microcapsules.

In order to obtain a practically transparent heat-sensitive layer, a developer to an electron-donating dye precursor or a coupler to a diazo compound is first dissolved in an organic solvent slightly soluble or insoluble in water and then the resultant solution is mixed with a water phase containing a surfactant and a water-soluble polymer as a protective colloid to produce a dispersion in the form of an emulsion for the formation of the heat-sensitive layers.

The organic solvent to be used for dissolving the developer or coupler may be appropriately selected from organic oils having high boiling points. Particularly preferred are an ester and an oil which is known for use thereof as an oil for use pressure-sensitive materials and which has two or more benzene rings and has hetero-atoms in less than a certain number. Examples of the oil are the compounds represented by the following general formulas (5) to (7) and a triaryl methane (e.g., tritolyl methane and tolyldiphenyl methane), a terphenyl compound, an alkyl compound (e.g., terphenyl), an alkylated diphenyl ether (e.g., propyldiphenyl ether), a hydrogenated terphenyl (e.g., hexahydroterphenyl) and diphenyl ether. Particularly, the use of the ester is preferred from the viewpoint of the stability of the emulsion of the developer or coupler.

General Formula (5)

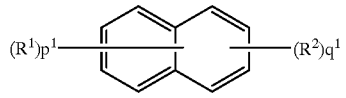

where $R^1$ is hydrogen or an alkyl group of 1 to 18 carbon atoms and $R^2$ is an alkyl group of 1 to 18 carbon atoms. $p^1$ and $q^2$ are each an integer of 1 to 4 with the proviso that the total number of the alkyl group does not exceed 4. Preferably, the $R^1$ and $R^2$ alkyl group are each an alkyl group of 1 to 18 carbon atoms.

General Formula (6)

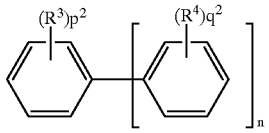

where $R^3$ is hydrogen or an alkyl group of 1 to 12 carbon atoms and $R^4$ is an alkyl radical of 1 to 12 carbon atoms. n is 1 or 2. $p^2$ and $q^2$ are each an integer of 1 to 4, with the proviso that the total number of the alkyl group does not exceed 4 where n is 1 and that the total number of the alkyl group does not exceed 6 where n is 2.

General Formula (7)

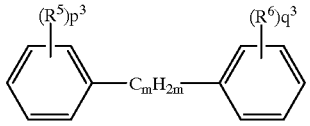

where $R^5$ and $R^6$ are each hydrogen or the same or different alkyl group of 1 to 18 carbon atoms. m is an integer of 1 to 13. $p^3$ and $q^3$ are each an integer of 1 to 3, with the proviso that the total number of the alkyl radicals does not exceed 3. Preferably, the $R^5$ and $R^6$ alkyl group are each an alkyl group of 2 to 4 carbon atoms.

Examples of the compounds represented by the formula (5) include dimethyl naphthalene, diethyl naphthalene and diisopropyl naphthalene.

Examples of the compounds represented by the formula (6) include dimethyl biphenyl, diethyl biphenyl, diisopropyl biphenyl and diisobutyl biphenyl.

Examples of the compounds represented by the formula (7) include 1-methyl-1-dimethylphenyl-1-phenylmethane, 1-ethyl-1-dimethylphenyl-1-phenylmethane and 1-propyl-1-dimethylphenyl-1-phenylmethane.

Examples of the ester include phosphoric acid esters (e.g., triphenyl phosphate, tricresyl phosphate, butyl phosphate, octyl phosphate and cresyldiphenyl phosphate), phthalic acid esters (e.g., dibutyl phthalate, 2-ethylhexyl phthalate, ethyl phthalate, octyl phthalate and butylbenzyl phthalate), dioctyl tetrahydrophthalate, benzoic acid esters (e.g., ethyl benzoate, propyl benzoate, butyl benzoate, isopentyl benzoate and benzyl benzoate), abietic acid esters (e.g., ethyl abietate and benzyl abietate), dioctyl adipate, isodecyl succinate, dioctyl azelate, oxalic acid esters (e.g., dibutyl oxalate and dipentyl oxalate), diethyl malonate, maleic acid esters (e.g., dimethyl maleate, diethyl maleate and dibutyl maleate), tributyl citrate, sorbic acid esters (e.g., methyl sorbate, ethyl sorbate and butyl sorbate), sebacic acid esters (e.g., butyl cebacate and dioctyl cebacate), ethylene glycol esters (e.g., monoester and diester of oxalic acid, monoester and diester of butyric acid, monoester and diester of lauric acid, monoester and diester of palmitic acid, monoester and diester of stearic acid and monoester and diester of oleic acid), triacetin, diethyl carbonate, diphenyl carbonate, ethylene carbonate, propylene carbonate and boric acid esters (e.g., tributyl borate and tripentyl borate).

A combination of two or more of the above-mentioned oils and a combination of any of the above-mentioned oils with one or more of other oils are possible.

The above-mentioned organic solvent may be admixed with a solvent of a lower boiling point as an auxiliary solvent. Preferred examples of the auxiliary solvent include ethyl acetate, isopropyl acetate and methylene chloride.

The water phase, which is to be added to an oil phase containing a dissolved developer or coupler, may contain a water-soluble polymer as a protective colloid. The water-soluble polymer may be appropriately chosen from the group consisting of known anionic polymers, nonionic polymers and amphoteric polymers and preferred examples of the water-soluble polymer include polyvinylalcohol, gelatin and cellulose derivatives.

A surfactant, which is present in the water phase, may be appropriately chosen from anionic surfactants and nonionic surfactants, provided that the surfactant does not react with the protective colloid to cause precipitation or coagulation. Preferred examples of the surfactant include an alkylbenzenesulfonic acid sodium salt (e.g., sodium lauryl sulfate), sodium salt of dioctyl sulfosuccinate, polyalkylene glycol (e.g., polyoxyethylene nonylphenyl ether).

An emulsion of developer or coupler can be easily obtained by blending an oil phase, which contains a developer or coupler, with a water phase, which contains a protective colloid and surfactant, utilizing an ordinary emulsifying means such as a high-speed stirring means or an ultrasonic dispersing means.

In this case, the size (diameter) of the oil drop of the obtained emulsion is preferably not greater than 7 $\mu$m, most preferably in the range of 0.1 to 5 $\mu$m, in order to obtain a transparent heat-sensitive layer having a haze not exceeding 60%.

The ratio of the oil phase to the water phase (weight of the oil phase/weight of the water phase) is preferably in the range of 0.02 to 0.6 and most preferably in the range of 0.1 to 0.4. If the ratio is less than 0.02, the amount of the water phase is too large to obtain a sufficient capability of color formation, whereas if the ratio is greater than 0.6, the viscosity of the resultant liquid is too high to handle and the transparency of the liquid diminishes.

In addition to the above-mentioned materials, an acid stabilizing agent may be added, for example; citric acid, tartaric acid, oxalic acid, boric acid, phosphoric acid or pyrophosphoric acid.

In order to coat the recording material onto a substrate, the recording material may contain a binder.

The binder may be an emulsion based on such material as polyvinylalcohol, methyl cellulose, carboxymethyl cellulsoe, hydroxypropyl cellulose, gum arabic, gelatin, polyvinylpyrrolidone, casein, a styrene/butadiene latex, an arylionitrile/butadiene latex, polyvinylacetate, polyacrylate or an ethylene/vinyl acetate copolymer. The coating weight based on solids is in the range of 0.5 to 5 g/m$^2$.

The coating weight of the recording layer is in the range of 3 to 20 g/m$^2$ and preferably in the range of 5 to 15 g/m$^2$. If the coating weight is less than 3 g/m$^2$, a sufficient sensitivity is not obtained, whereas a coating weight more than 20 g/m$^2$ brings about no further enhancement in the quality and therefore is uneconomical. In order to improve the preservation of the reactivity of the heat-sensitive material, preservation of the recorded image and distinctness of the colors of the image, it is preferred to provide an intermediate layer between the heat-sensitive layers. A preferred example of the intermediate layer is a layer made by the gelification of a water-soluble polyanionic polymer by means of a polyvalent cation.

The water-soluble polyanionic polymer is preferably a polymer having a carboxyl group, sulfonic acid group or phosphoric acid group, and particularly preferred is a polyanionic polymer having a carboxyl group. Preferred examples of the water-soluble polyanionic polymer include natural or synthetic polysaccharide gums (e.g., alkali metal salts of alginic acid, guaiac gum, gum arabic, chalazinan, pectin, tragacanth gum and xanthene gum), polymers or copolymers of acrylic acid or methacrylic acid, polymers or copolymers of maleic acid or phthalic acid, cellulose derivatives such as carboxymethyl cellulose, gelatin and agar. Particulary preferred is an alkali metal salt of alginic acid. The molecular weight of the water-soluble polyanionic polymer is in the range of 5,000 to 10,000 and preferably in the range of 10,000 to 40,000, because of the barrier-property required in the present invention and suitability to the production. Preferred examples of the polyvalent cation include salts of alkal earth metals or other polyvalent metals (e.g., $CaCl_2$, $BaCl_2$, $Al_2(SO_4)_3$ and $ZnSO_4$), polyamines (e.g., ethylene diamine, diethylene triamine and hexamethylene diamine) and polyimies.

A preferred example of the intermediate layer is an ion complex of a water-soluble polyanionic polymer and a water-soluble polycationic polymer. In this case, the water-soluble polyanionic polymer may be chosen from the above-mentioned water-soluble polyanionic polymers.

A preferred polycationic polymer is selected from the group consisting of proteins containing a cationic group having a plurality of reactive nitrogen atoms, polypeptides such as polylysine, polyvinylamines, polyethylene amines and polyethylene imines.

When producing an intermediate layer by coating, it is preferred that any one of the water-soluble polyanionic polymer and a polyvalent cation be incorporated into any one of the heat-sensitive layers adjacent to the intermediate layer in order to prevent a rapid gelification at the time of coating operation. Further, it is also possible to adjust temperatures and pH values or to incorporate one of the above-mentioned substances into the other heat-sensitive layer adjacent to the intermediate layer.

The coating weight of the intermediate layer is preferably in the range of 0.05 to 5 g/m$^2$ and most preferably in the range of 0.1 to 2 g/m$^2$.

In order to enhance the color separation, at least the outermost heat-sensitive layer and the second heat-sensitive layer need to be practically transparent. The term "practically transparent" means a haze percent not greater than 60% as measured by means of a haze meter (an integrated sphere method, using HTR Meter manufactured by Nippon Seimitsu Kogyo Co., Ltd.). The haze is preferably not greater than 40% and most preferably not greater than 30%. When measuring the transparency of the specimen of the heat-sensitive layer, the scattered light due to very minute roughness on the surface significantly affects the observed value. Accordingly, when measuring the transparency inherent to a heat-sensitive layer interior, a convenient treatment is necessary prior to the measurement, that is, a transparent adhesive tape is adhered to the surface of the heat-sensitive layer and then the measurement is performed from the surface of the tape so that the scattered light on the surface is almost eliminated.

The above-described level of transparency can be easily achieved by use of the developer or coupler in the form of an emulsion.

In the practice of the present invention, preferably a protective layer is coated onto the outermost layer of the heat-sensitive recording material in order to enhance the scratch resistance or to prevent the sticking of the outermost heat-sensitive layer. Two or more layers of the protective layers may be formed. The transparent protective layer usable in the present invention comprises at least a silicon-modified polyvinylalcohol and a colloidal silica.

The silicon-modified polyvinylalcohol is not particularly limited in so far as it contains silicon atoms in the molecule. Preferably, the silicon atom has a reactive substituent selected from the group consisting of an alkoxyl, an acyloxyl or hydroxyl group derived from hydrolysis and an alkali metal salt of the foregoing groups. The details of the silicon-modified polyvinylalcohol containing silicon atoms in the molecule thereof are described in Japanese Patent Application Laid-Open (JP-A) No. 58-193189.

The colloidal silica is used as a colloidal solution in which ultra-fine silicic anhydride is dispersed utilizing the water as a dispersion medium. Preferably, the colloidal silica has particles in the range of 10 to 100 $\mu$m and has a specific gravity in the range of 1.1 to 1.3. Preferably, the colloidal solution has a pH value in the range of about 4 to about 10.

Like the aforementioned transparent adhesive tape, which is present on the heat-sensitive recording layer, the protective layer on the heat-sensitive recording material inhibits the light-scattering phenomenon on the surface and, surprisingly, the transparency of the protective layer is very good. In addition, since the protective layer enhances the mechanical strength of the heat-sensitive layer surface, the transparency of the heat-sensitive material as a whole can be significantly enhanced by the presence of the protective layer.

A proper ratio of the silicon-modified polyvinylalcohol to the colloidal silica is in the range of 0.5 to 3 parts by weight and preferably in the range of 1 to 2 parts by weight of the colloidal silica based on one part by weight of the silicon-modified polyvinylalcohol. If the amount of the colloidal silica is less than 0.5 parts by weight, the transparency is little enhanced, whereas the amount of the colloidal silica in an amount exceeding 3 parts by weight causes the cracking of the protective layer and thus impairs the transparency.

The protective layer may further contain one or more additional polymers. Examples of the additional polymers include water-soluble polymers such as methylcellulose, carboxymethylcellulose, hydroxymethylcellulose, starch, gelatin, gum arabic, casein, a hydrolysate of a styrene/maleic anhydride copolymer, a hydrolysate of a half ester of styrene/maleic anhydride copolymer, polyvinylalcohol, carboxy-modified polyvinylalcohol, a derivative of polyacrylamide, polyvinylpyrrolidone, a sodium salt of polystyrene sulfonic acid and sodium alginate as well as water-insoluble polymers such as a styrene/butadiene rubber latex, an arylionitrile/butadiene rubber latex, a methylacrylate/butadiene rubber latex and a polyvinylacetate emulsion. A preferred amount of the above-mentioned additional resin is in the range of 0.01 to 0.5 parts by weight based on one part by weight of the silicon-modified polyvinylalcohol.

To ensure suitability of thermal heads with the protective layers during the thermal printing operation and improvement in the water resistance of the protective layer, the protective layer may contain additives such as pigments, metal soaps, waxes and crosslinkers.

A preferred pigment has a refractive index in the range of 1.4 to 1.55 and a particle diameter of less than 1 $\mu$m. Examples of the pigment include calcium carbonate, talc, pagodite, kaolin, aluminum hydroxide and amorphous silica. The added amount of the pigment is in the range of 0.05 to 0.5 times and particularly in the range of 0.1 to 0.3 times the total weight of the polymers. If the amount added is less than 0.05 times, this suitability of the thermal heads is not improved, whereas an amount exceeding 0.5 times impairs the commercial value of the heat-sensitive recording material because the transparency and the sensitivity of the heat-sensitive recording material are significantly reduced.

Examples of the metal soap include an emulsion of a metal salt of a higher fatty acid such as zinc stearate, calcium stearate and aluminum stearate. The added amount of the metal soap is in the range of 0.5 to 20% by weight and preferably in the range of 1 to 10% by weight based on the total weight of the protective layer.

Examples of the wax include emulsions such as paraffin wax, micro-crystalline wax, carnauba wax, methylolstearoamide, polyethylene wax and silicone wax. The added amount of the wax is in the range of 0.5 to 40% by weight and preferably in the range of 1 to 20% by weight based on the total weight of the protective layer.

Further, in order to form the protective layer uniformly on the heat-sensitive layer, a surfactant is incorporated into a coating liquid to form the protective layer. Examples of the surfactant include an alkali metal salt of a compound based on sulfosuccinic acid and a fluorine-containing surfactant. More concrete examples are a sodium or ammonium salt of di-(2-ethylhexyl) sulfosuccinate or di-(n-hexyl) sulfosuccinate. In addition, for the purpose of inhibiting the electrostatic charge of the heat-sensitive recording material, the protective layer may be incorporated with an additive such as a surfactant or a polymeric electrolyte.

The coating weight of the protective layer based on solids is preferably in the range of 0.2 to 5 g/m$^2$ and most preferably in the range of 1 to 3 g/m$^2$.

In order to improve the adhesion between the substrate and the heat-sensitive layer, an undercoat may be provided between the two layers. Examples of the material constituting the undercoat include gelatin, synthetic polymer latices and nitrocellulose. The coating weight of the undercoat is preferably in the range of 0.1 to 2.0 g/m$^2$ and most preferably in the range of 0.2 to 1.0 g/m$^2$. If the coating weight is less than 0.1 g/m$^2$, the adhesion between the substrate and the heat-sensitive layer is insufficient, whereas a coating weight of more than 2.0 g/m$^2$ brings about no further improvement in the adhesion and therefore is uneconomical.

When the undercoat is overcoated with a liquid for forming a heat-sensitive layer, the water contained in the coating liquid can cause the undercoat to swell to an extent that the quality of image to be recorded in the heat-sensitive layer will be impaired. Therefore, it is preferred that the undercoat be hardened by use of a curing agent. Examples of the curing agent are given below.

(1) compounds having an active vinyl group such as divinylsulfone-N,N'-ethylene-bis(vinylsulfonylacetamide), 1,3-bis(vinylsulfonyl)-2-propanol, methylene-bismaleimide, 5-acetyl-1,3-diacryloyl-hexahydro-s-triazine, 1,3,5-triacryloyl-hexahydro-s-triazine and 1,3,5-trivinylsulfonyl-hexahydro-s-triazine.

(2) compounds having active halogen such as 2,4-dichloro-6-hydroxy-s-triazine-sodium salt, 2,4-dichloror-6-methoxy-s-triazine, 2,4-dichloro-6-(4-sulfoanilino)-s-triazine-sodium salt, 2,4-dichloro-6-(2-sulfoethylamino)-s-triazine and N-N'-bis(2-chloroethylcarbamyl)piperazine.

(3) epoxy compounds such as bis(2,3-epoxypropyl) methylpropylammonium-p-toluenesulfonic acid salt, 1,4-bis (2',3'-epoxypropyloxy)butane, 1,3,5-triglycidylisocyanurate and 1,3-diglycidyl-5-(γ-acetoxy-β-oxypropyl)isocyanurate.

(4) ethyleneimino compounds such as 2,4,6-triethylene-s-triazine, 1,6-hexamethylene-N-N'-bisethylene urea and bis-β-ethyleneiminoethyl thioether.

(5) methanesulfonic acid esters such as 1,2-di (methanesulfonoxy)ethane, 1,4-di(methanesulfonoxy) butane and 1,5-di(methanesulfonoxy)pentane.

(6) carbodimides such as dicyclohexyl carbodiimide, 1-cyclohexyl-3-(3-trimethylaminopropyl)carbodiimide-p-toluenesulfonic acid salt and 1-ethyl-3-(3-dimethylaminopropyl)carbodiimide-hydrochloric acid salt.

(7) isooxazoles such as 2,5-dimethylisooxazole-perchloric acid salt, 2-ethyl-5-phenylisooxazole-3'-sulfonate and 5,5'-(paraphenylene)bisisooxazole.

(8) inorganic compounds such as chromium alum and chromium acetate.

(9) peptides formed by dehydrating condensation such as N-carboethoxy-2-isopropoxy-1,2-dihydroquinoline and N-(1-morpholinocarboxy)-4-methylpyridinium chloride; and active esters such as N,N'-adipoyldioxydisuccinimide and N,N'-terephthaloyldioxydisuccinimide.

(10) isocyanates such as toluene-2,4-diisocyante and 1,6-hexamethylene diisocyanate.

(11) dialdehydes such as glutalaldehyde, glyoxal, dimethoxyurea and 2,3-hydroxy-1,4-dioxane.

Among the compounds enumerated in the above, particularly preferred are dialdehydes such as glutalaldehyde and 2,3-dihydroxy-1,4-dioxane and boric acid.

The added amount of the curing agent is in the range of 0.20 to 3.0% by weight based on the weight of the undercoat. The added amount of the curing agent can be appropriately determined depending on such factors as coating method and desired level of curing. If the added amount is less than 0.20% by weight, the level of curing remains insufficient even after a lapse of time and the undercoat swells when overcoated with a heat-sensitive layer. However, an added amount of the curing agent exceeding 3.0% by weight cures the undercoat to such an extent that delamination occurs between the undercoat and the substrate. If necessary, depending on the type of the curing agent, pH may be raised by the addition, for example, of sodium hydroxide or lowered by the addition, for example, of citric acid.

Further, it is possible to add a defoaming agent to prevent foaming during the coating operation and also to add a surfactant to improve the leveling of the coating liquid and to prevent streaking. If necessary, antistatic agents may be added and a white pigment may be incorporated in the undercoat to opacify it.

Prior to the application of the undercoat, it is preferred to activate the surface of the substrate by a publicly known pre-treatment method. Examples of the pre-treatment include an etching treatment by means of an acid, a flame treatment by means of a gas burner, a corona discharge and a glow discharge. Because of inexpensiveness and simplicity of the treatment, the most preferred is a corona discharge treatment, which is described in U.S. Pat. Nos. 2,715,075, 2,846,727, 3,549,406 and 3,590,107.

The coating liquid may be applied by a commonly known method. For example, dip coating, air knife coating, curtain coating, roller coating, doctor coating, wire bar coating, slide coating, gravure coating and extrusion coating utilizing a hopper as described in U.S. Pat. No. 2,681,294. If necessary, the undercoat may be applied in two or more coats simultaneously as described, for example, in U.S. Pat. Nos. 2,761,791, 3,508,947, 2,941,898 and 3,526,528 or in "Coating Technology" by U. Harasaki, page 253, Asakura Publishing Co., Ltd. 1973.

In so far as the properties of the coating liquid are not impaired, the coating liquid may be admixed with an additive such as a pigment dispersant, a thickening agent, a thixotropic agent, a defoaming agent, a releasing agent or a coloring agent.

The multicolor heat-sensitive recording material according to the present invention can be used as a multicolor sheet for high-speed printers of facsimile or electronic computers. When using the recording material of the present invention, which utilizes a diazo compound as a color former, it is advantageous to provide an exposure zone for photo-decomposition to increase preservation of the image and multicoloration of the image.

The arrangement of a printing head and an exposure zone is roughly divided into two systems. The first one is the one head multi-scanning system. As the printing operation is performed, the image printed undergoes light irradiation for photo-decomposition, wherein, before and after the irradiation, a feeding mechanism positions the recording material to a stand-by state to enable a further printing operation to the already printed area so that the same procedure is repeated for subsequent printing operations. The other system is the multi-head one scanning system characterized in that the system has recording heads in a number corresponding to the number of colors to be recorded and has irradiation zones between the heads. If necessary, the two systems may be combined. The light source for the photo-decomposition may be any light source radiating a light of a desired wavelength. Examples of the light source include fluorescent lamps, xenon lamps, xenon flash lamps, mercury lamps of various pressures, flashes for photography and stroboscopic light. Besides, in order to make the photo-fixation zone compact, the light source and the exposure zone may be separated by means of an optical fiber.

One of the heat-sensitive layers within a multicolor heat-sensitive recording material can form any one color selected from Y (yellow), M (magenta) and C (cyan) so that the heat-sensitive layers as a whole form a full color to reproduce an image. However, an order of C, Y and M or an order of C, M and Y from the side of the substrate is preferred from the viewpoint of color reproduction.

Although the foregoing explanation about the recording material is centered on a multicolor heat-sensitive recording material, the recording material according to the present invention can find an application as a recording material other than the use as a recording material having multicolor heat-sensitive recording layers. Further, the recording material according to the present invention is applicable to a recording material having a silver halide-based photosensitive layer. In these recording materials, if the oxygen transmission rate of the substrate, as measured in accordance with Method B of JIS K 7126, is no greater than 50 cc/m$^2$/day, the amount of oxygen, which passes through the substrate and reaches the recording layer or the silver halide photosensitive layer, is remarkably reduced with the result that the degree of the oxidation of the ingredients contained in the recording layer or in the silver halide-based photosensitive layer is decreased thereby decreasing the tinting of the non-image area and the discoloration or fading of the image area.

EXAMPLES

In order to better explain the present invention, the following examples are given by way of illustration and not by way of limitation. All parts are by weight unless otherwise specified.

Example 1

Wood pulp comprising 100 parts of LBKP was beaten to 300 cc in Canadian Freeness by use of a double disc refiner and was admixed with 0.5 parts of epoxidized behenic acid amide, 1.0 part of anionic polyacrylamide, 0.1 parts of a polyamidepolyamine/epichlorohydrin adduct and 0.5 parts of cationic polyacrylamide, each calculated in absolute dry condition based on the weight of the pulp. The pulp was fed to a long-mesh paper machine to produce a base paper having a basis weight of 100 g/m$^2$, which was sized with polyvinylalcohol in an amount of 1.0 g/m$^2$ in absolute dry condition and then adjusted to a specific gravity of 1.0.

Then, the mesh wire-facing side (the back) of the paper was subjected to a corona discharge treatment and thereafter was coated with a high-density polyethylene resin to a resin layer thickness of 30 $\mu$m by means of a melt-extruder and a resin layer having a mat surface was formed (this face is hereinafter referred to as the back). The polyethylene coating layer on the back was treated with a corona discharge and then coated with an anti-static agent comprising an aqueous dispersion of aluminum oxide ("Alumina Sol 100" from Nissan Chemical Industries, Ltd.) and silicon dioxide ("Snowtex 0" from Nissan Chemical Industries, Ltd.) in 1:2 weight ratio so that a dry coating weight of 0.2 g/m$^2$ was obtained (this laminate is hereinafter referred to as PE-backed laminate).

Meanwhile, the felt face (the front) of the paper was treated with a corona discharge and thereafter was coated with an ethylene/vinylalcohol random copolymer ("Eval EP-F101" from Kuraray Co., Ltd.) to a resin layer thickness of 10 $\mu$m by means of melt-extrusion. The resin layer was treated with a corona discharge and was further coated with a low-density polyethylene resin, which contained 10% by weight of titanium dioxide and a trace of ultramarine blue, to a resin layer thickness of 30 $\mu$m by means of melt-extrusion to produce a resin layer having a glossy surface (this face is hereinafter referred to as the front). The polyethylene coating on the front was treated with a corona discharge and then coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd.. The oxygen transmission rate was 1.5 cc/m$^2$/day.

Example 2

One side of a polyethylene terephthalate film, which had an oxygen transmission rate of 55 cc/m$^2$/day and a thickness of 15 $\mu$m, was coated with a two-component polyurethane adhesive having the following composition at a coating weight of 4 g/m$^2$.

"Polybond AY-651A" (from Sanyo Chemical Industries, Ltd.): 100 parts

"Polybond AY-651C" (from by Sanyo Chemical Industries, Ltd.): 15 parts

The film was dried for 2 minutes at 100° C. and thereafter was laminated with the base paper prepared in Example 1 under a pressure of 20 kg/cm$^2$ at 40° C.

Next, a corona discharge was conducted to the side of the substrate opposite to the plastic film. Then, the discharge-treated surface was coated with a high-density polyethylene resin to a resin layer thickness of 30 $\mu$m by means of a melt-extruder. In this way, a resin layer with a mat surface was formed (this face is hereinafter referred to as the back). The polyethylene coating layer on the back was treated with a corona discharge and then coated with an anti-static agent comprising an aqueous dispersion of aluminum oxide ("Alumina Sol 100" from Nissan Chemical Industries, Ltd.) and silicon dioxide ("Snowtex 0" from Nissan Chemical Industries, Ltd.) in 1:2 weight ratio so that a dry coating weight of 0.2 g/m$^2$ was obtained.

Meanwhile, the surface of the laminated plastic film was treated with a corona discharge and thereafter was coated with a low-density polyethylene resin, which contained 10% by weight of titanium dioxide and a trace of ultramarine blue, to a resin layer thickness of 30 $\mu$m by means of a melt-extruder to produce a resin layer having a glossy surface (this face is hereinafter referred to as the front). The polyethylene coating on the front was treated with a corona discharge and then coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 24 cc/m$^2$/day.

Example 3

The PE-backed laminate of Example 1 was used in the following way. The felt face of the paper was treated with a corona discharge and thereafter was coated with a low-density polyethylene resin, which contained 10% by weight of titanium dioxide and a trace of ultramarine blue, to a resin layer thickness of 30 $\mu$m by means of melt-extrusion to produce a resin layer having a glossy surface (this face is hereinafter referred to as the front). The polyethylene layer on the front was coated with polyvinylidene chloride ("Kurehalon SOA110" from Kureha Chemical Industry, Co., Ltd.) at a coating weight on absolute dry basis of 4 g/m$^2$ and then coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 45 cc/m$^2$/day.

Example 4

A substrate was prepared by repeating the procedure of Example 3 except that an ethylene/vinylalcohol random copolymer ("Eval EP-F104A" from Kuraray Co., Ltd.) was applied at a coating weight on absolute dry basis of 4 g/m$^2$ in place of the polyvinylidene chloride and further coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 8 cc/m$^2$/day.

Example 5

A substrate was prepared by repeating the procedure of Example 2 except that a 12 $\mu$m-thick biaxially stretched film of an ethylene/vinylalcohol random copolymer ("Eval EF-XL" from Kuraray Co., Ltd.) was used in place of the polyethylene terephthalate film. The film had an oxygen transmission rate of 0.5 cc/m$^2$/day, as measured in accordance with Method B of JIS K 7126.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 0.4 cc/m$^2$/day.

Example 6

The PE-backed laminate of Example 1 was used in the following way. The felt face of the paper (the front) was treated with a corona discharge and thereafter was coated with three layers by means of a three-layer melt-coextruder so that the top surface (hereinafter referred to as the front) is glossy. Of these three resin layers, the innermost layer consisted of a 10 $\mu$m-thick ethylene/vinylalcohol random copolymer ("Eval EP-F101" from Kuraray Co., Ltd.). The intermediate layer consisted of a 5 $\mu$m-thick ethylene/vinyl acetate copolymer ("ADMER VF-500" from Mitsui Petrochemical Industries, Ltd.) as a tie coat. The top layer consisted of a 25 $\mu$m-thick low-density polyethylene resin containing 10% by weight of titanium dioxide and a trace of ultramarine blue.

The top layer (the front) was subjected to a corona discharge treatment and then coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 1.3 cc/m$^2$/day.

Comparative Example 1

The felt face of the paper of Example 1 (the front) was treated with a corona discharge and thereafter was coated with a low-density polyethylene resin, which contained 10% by weight of titanium dioxide and a trace of ultramarine blue, to a resin layer thickness of 40 $\mu$m by means of a melt-extruder to produce a resin layer having a glossy surface (this face is hereinafter referred to as the front). The polyethylene coating on the front was subjected to a corona discharge treatment and then coated with a gelatin undercoat so that a dry coating weight of 0.1 g/m$^2$ was obtained.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 1500 cc/m$^2$/day.

Comparative Example 2

A substrate was prepared by repeating the procedure of Example 2 except that a 15 $\mu$m-thick polypropylene film was used in place of the polyethylene terephthalate film for the lamination with the paper of Example 1.

The substrate obtained in the above-described way was subjected to the measurement of the oxygen transmission rate in accordance with Method B of JIS K 7126 by use of OX-TRAN2/20MH manufactured by MOCON Co., Ltd., and the obtained oxygen transmission rate was 800 cc/m$^2$/day.

The following full-color heat-sensitive recording layers were formed on the substrates of Examples 1–6 and of Comparative Examples 1–2 after a corona discharge treatment.

Examples of the full-color heat-sensitive recording materials are given below.

(1) Preparation of a coating liquid for forming a cyan heat-sensitive recording layer (Preparation of a capsule liquid containing an electron-donating dye precursor)

1. Liquid (A)

3-(o-methyl-p-dimethylaminophenyl)-3-(1'-ethyl-2-methylindole-3-il)phthalide (electron-donating dye precursor) was dissolved in 20 parts of ethylacetate and the resulting solution was admixed with 20 parts of alkyl naphthalene (solvent having a high boiling point) and thereafter the mixture was heated to form a homogeneous solution.

The above solution was admixed with 20 parts of a xylylenediisocyanate/trimethylol propane 1/3 adduct and the mixture was stirred to form a homogeneous liquid. In this way, liquid (A) was prepared.

2. Liquid (B)

Liquid (B) was prepared by adding 2 parts of an aqueous solution containing 2% by weight of sodium dodecyl sulfonate to 54 parts of an aqueous solution containing 6% by weight of phthalylated gelatin.

Liquid (A) was added to liquid (B) and the mixture was emulsified by means of a homogenizer. The emulsion thus obtained was admixed with 68 parts of water and stirred to form a uniform mixture. This was heated and stirred at 50° C. for 3 hours to carry out an encapsulation reaction to obtain a capsule liquid containing microcapsules of an average particle diameter of 1.2 $\mu$m.

(Preparation of a developer emulsion)

Five parts of 1,1-(p-hydroxyphenyl)-2-ethylhexane (developer), 0.3 parts of tricresyl phosphate and 0.1 parts of diethyl maleate were dissolved in 10 parts of ethyl acetate. The resulting solution was added to a solution, which was composed of 50 g of an aqueous solution containing 6% by weight of gelatin and 2 g of an aqueous solution containing 2% by weight of sodium dodecyl sulfonate, and the mixture was emulsified for 10 minutes to prepare an emulsion.

(Preparation of a coating liquid)

A coating liquid was prepared by blending the capsule liquid containing the electron-donating dye precursor with the developer emulsion at a weight ratio of 1:4, respectively.

(2) Preparation of a coating liquid for forming a magenta heat-sensitive recording layer (Preparation of a capsule liquid containing a diazo compound)

Two parts of 4-N-(2-(2,4-di-tert-aminophenoxy)butylyl) piperazinobenzene diazonium hexafluorophosphate (diazo compound: photo-decomposable at a wavelength of 365 nm) was dissolved in 20 parts of ethylacetate and the resulting solution was admixed with 20 parts of alkyl naphthalene and thereafter the mixture was heated to form a homogeneous solution. The above solution was admixed with 15 parts of a xylylenediisocyanate/trimethylol propane 1/3 adduct and the mixture was stirred to form a homogeneous solution. In this way, a solution of the diazo compound was obtained.

The solution of the diazo compound was added to a solution composed of 54 parts of an aqueous solution containing 6% by weight of phthalylated gelatin and 2 parts of an aqueous solution containing 2% by weight of sodium dodecyl sulfonate. The mixture was emulsified by means of a homogenizer.

The emulsion thus obtained was admixed with 68 parts of water and stirred to form a uniform mixture. This was heated and stirred at 40° C. for 3 hours to carry out an encapsulation reaction to obtain a capsule liquid containing microcapsules of an average particle diameter of 1.2 μm.

(Preparation of a coupler emulsion)

Two parts of 1-(2'-octylphenyl)-3-methyl-5-pyrazolone (coupler), 2 parts of 1,2,3-triphenylguanidine, 0.3 parts of tricresyl phosphate and 0.1 parts of diethyl maleate were dissolved in 10 parts of ethyl acetate. The resulting solution was added to a solution, which was composed of 50 g of an aqueous solution containing 6% by weight of gelatin and 2 g of an aqueous solution containing 2% by weight of sodium dodecyl sulfonate, and the mixture was emulsified for 10 minutes to prepare an emulsion.

(Preparation of a coating liquid)

A coating liquid was prepared by blending the capsule liquid containing the diazo compound with the coupler emulsion at a weight ratio of 2:3, respectively.

(3) Preparation of a coating liquid for forming a yellow heat-sensitive recording layer (Preparation of a capsule liquid containing a diazo compound)

Three parts of 2,5-dibutoxy-4-tolylthiobenzene diazonium hexafluorophosphate (diazo compound: photo-decomposable at a wavelength of 420 nm) was dissolved in 20 parts of ethylacetate and the resulting solution was admixed with 20 parts of alkyl naphthalene as a solvent having a high boiling point and thereafter the mixture was heated to form a homogeneous solution.

The above solution was admixed with 15 parts of a xylylenediisocyanate/trimethylol propane 1/3 adduct as a capsule wall forming material and the mixture was stirred to form a homogeneous solution. In this way, a solution of the diazo compound was obtained.

The solution of the diazo compound was added to a solution composed of 54 parts of an aqueous solution containing 6% by weight of phthalylated gelatin and 2 parts of an aqueous solution containing 2% by weight of sodium dodecyl sulfonate. The mixture was emulsified by means of a homogenizer.

The emulsion thus obtained was admixed with 68 parts of water and stirred to form a uniform mixture. This was heated and stirred at 40° C. for 3 hours to carry out an encapsulation reaction to obtain a capsule liquid containing microcapsules of an average particle diameter of about 1.3 μm.

(Preparation of a coupler emulsion)

Two parts of 2-chloro-5-(3-(2,4-di-tert-pentyl) phenoxypropylamino)acetoactanilide, 1 part of 1,2,3-triphenylguanidine, 0.3 parts of tricresyl phosphate and 0.1 parts of diethyl maleate were dissolved in 10 parts of ethyl acetate. The resulting solution was added to a solution, which was composed of 50 g of an aqueous solution containing 6% by weight of gelatin and 2 g of an aqueous solution containing 2% by weight of sodium dodecyl sulfonate, and the mixture was emulsified for 10 minutes to prepare an emulsion.

(Preparation of a coating liquid)

A coating liquid was prepared by blending the capsule liquid containing the diazo compound and the coupler emulsion at a weight ratio of 2:3, respectively.

(4) Preparation of an intermediate layer forming coating liquid

An intermediate layer forming coating liquid was prepared by homogeneously blending 10 parts of an aqueous solution containing 15% by weight of gelatin (#750 from Nitta Gelatin Co., Ltd.) and 3 parts of an aqueous solution containing 15% by weight of polyacrylic acid (Julimer AC-10L from Nippon Junyaku Co., Ltd.).

(5) Preparation of a protective layer forming coating liquid

A protective layer forming coating liquid was prepared by first blending 100 g of an aqueous solution containing 6% by weight of itaconic acid-modified polyvinylalcohol (KL318 from Kuraray Co., Ltd.) and 10 g of an aqueous dispersion containing 30% by weight of epoxy-modified polyamide (FL-71 from Toho Chemical Industry, Co., Ltd.) and then admixing the foregoing liquid with 15 g of an aqueous dispersion containing 40% by weight of zinc stearate (Hydrin Z from Chukyo Yushi Co., Ltd.).

(6) Preparation of heat-sensitive recording materials

Each of the sheet-like substrates obtained in Examples 1–6 and in Comparative Examples 1–2 was multiply coated in a successive manner with the coating liquids to form a cyan heat-sensitive recording layer, an intermediate layer, a magenta heat-sensitive recording layer, an intermediate layer, a yellow heat-sensitive layer and a protective layer, in that order from the substrate, on a slide by means of a slide-type hopper-based beads coater. The coated substrates were each dried to obtain a multicolor heat-sensitive recording material.

The coating weights, based on solids after drying, were 6.1 g/m$^2$ for the cyan heat-sensitive layer, 1.0 g/m$^2$ for the intermediate layer, 7.8 g/m$^2$ for the magenta heat-sensitive recording layer, 1.0 g/m$^2$ for the intermediate layer, 7.2 g/m$^2$ for the yellow heat-sensitive layer and 2.0 g/m$^2$ for the protective layer, in accordance with the above-mentioned coating order.

Utilizing each of the multicolor recording materials obtained from substrates of Examples 1–6 and in Comparative Examples 1–2, thermal recording was effected and evaluation was made with respect to light fastness and fogging in non-image areas.

Thermal recording was effected in the following way.

Utilizing a thermal head (KST from Kyocera Corporation), (1) an image in yellow was recorded in a heat-sensitive recording material by choosing an electric power and pulse width for the thermal head so that the recording energy per unit area was 35 mJ/mm$^2$. (2) The recording material was irradiated for 10 seconds with a 40 W UV lamp having a center wavelength of 420 nm. (3)

Again, an image in magenta was recorded in the heat-sensitive recording material by choosing an electric power and pulse width for the thermal head so that the recording energy per unit area was 66 mJ/mm$^2$. (4) Further, the recording material was irradiated for 15 seconds with a 40 W UV lamp light having a center wavelength of 365 nm. (5) Yet again, an image in cyan was recorded in the heat-sensitive recording material by choosing an electric power and pulse width for printing so that the recording energy per unit area was 90 mJ/mm$^2$. As a result, in addition to the images colored each in yellow, magenta and cyan, the areas recorded in overlap were colored as follows: yellow and magenta produced red; magenta and cyan produced blue; yellow and cyan produced green; and yellow and magenta and cyan produced black. The non-recorded area was white.

Evaluation Methods (1) Light fastness (Rate of Remaining Image)

The images were subjected to the irradiation for 48 hours at 0.9 W/m$^2$ in Weatherometer C1 65 (manufactured by Atlas Electric Devices Co.). For the non-printed area, a reflection density (yellow component) by means of "Reflection Densitometer RD 918" (manufactured by Macbeth Co.) was used as a criterion. For the image area, a remaining rate of cyan density was evaluated.

Rate of remaining density at image area(%)=[(Reflection Density after exposure to Weatherometer)/(Reflection Density before exposure to Weatherometer)]×100. The rate should be at least 85% for practical level of light fastness.

(2) Fogginess

Following the Wetherometer C1 65 (manufactured by Atlas Electric Devices Co.) 48 hour exposure at 0.9 W/m$^2$, the non-printed area of the specimens were evaluated for fogging. Reflection Densitometer RD 918 (manufactured by Macbeth Co.) was used.

TABLE 1

| | Oxygen Transmission Rate for Substrates | Light Fastness (Rate of Remaining Image) | Fog in non-image area |
|---|---|---|---|
| Ex. 1 | 1.5 CC/m$^2$/day | 87% | 0.13 |
| Ex. 2 | 24 CC/m$^2$/day | 88% | 0.14 |
| Ex. 3 | 45 CC/m$^2$/day | 87% | 0.14 |
| Ex. 4 | 8.0 CC/m$^2$/day | 87% | 0.13 |
| Ex. 5 | 0.4 CC/m$^2$/day | 88% | 0.12 |
| Ex. 6 | 1.3 CC/m$^2$/day | 88% | 0.13 |
| Comp. Ex. 1 | 1500 CC/m$^2$/day | 75% | 0.25 |
| Comp. Ex. 2 | 800 CC/m$^2$/day | 74% | 0.23 |

Ex.: Example
Comp. Ex.: Comparative Example

From Table 1, it can be seen that the heat-sensitive recording materials of Examples 1–6 each have an oxygen transmission rate for substrate of less than 50 cc/m$^2$/day, a rate of remaining image of more than 85% and a fog of less than 0.15 and that these recording materials have characteristics required in practical use.

As stated above, the present invention provides a recording material which has a low rate of oxygen transmission substrate and which is excellent in long-term image preservation, fading resistance and light fastness.

What is claimed is:

1. A recording material comprising a substrate and a heat-sensitive recording layer thereon, wherein the heat-sensitive recording layer contains a diazonium salt and a coupler which develops a color by reacting with the diazonium salt, and wherein the heat-sensitive recording layer is produced by laminating recording layers capable of coloring to yellow, magenta and cyan, respectively, and a protective layer is formed on the heat-sensitive recording layer, and the substrate comprises a sheet of base paper and a plastic film layer present at least on the side of the base paper at which the heat-sensitive recording layer is to be formed, and the plastic film layer is produced by melt-coextrusion of an olefinic resin and a random copolymer formed by copolymerizing ethylene and vinyl alcohol, and said recording material is characterized in that the oxygen transmission rate of the substrate is not greater than 50 cm$^3$/m$^2$·24 h·atm, wherein the oxygen transmission rate is calculated by the following equation:

$$O^2GTR=(E_e-E_0)Q/(AR)$$

where $O^2GTR$ is the oxygen transmission rate (cm$^3$/m$^2$·24 h·atm);

$E_e$ is the measured voltage (V);

$E_0$ is the base line voltage (V);

Q is a calibration constant;

A is the transmission area (cm$^2$); and

R is the load resistance (Ω).

2. A recording material according to claim 1, wherein the heat-sensitive recording layer is produced by laminating at least one recording layer which contains a diazonium salt and a coupler that reacts with the diazonium salt to develop a color, and another recording layer which contains an electron donating colorless compound and an electron accepting compound.

3. A recording material according to claim 2, wherein the random copolymer formed by copolymerizing ethylene and vinyl alcohol has an ethylene content in the range of 20 to 60 mole percent and a degree of saponification of not less than 90 mole percent.

4. A recording material according to claim 1, wherein the random copolymer formed by copolymerizing ethylene and vinyl alcohol has an ethylene content in the range of 20 to 60 mole percent and a degree of saponification of not less than 90 mole percent.

5. A recording material comprising a substrate and a heat-sensitive recording layer thereon, wherein the heat-sensitive recording layer contains an electron donating colorless compound and an electron accepting compound, and wherein the heat-sensitive recording layer is produced by laminating recording layers capable of coloring to yellow, magenta and cyan, respectively, and a protective layer is formed on the heat-sensitive recording layer, and the substrate comprises a sheet of base paper and a plastic film layer present at least on the side of the base paper at which the heat-sensitive recording layer is to be formed, and the plastic film layer is produced by melt-coextrusion of an olefinic resin and a random copolymer formed by copolymerizing ethylene and vinyl alcohol, and said recording material is characterized in that the oxygen transmission rate of the substrate is not greater than 50 cm$^3$/m$^2$·24 h·atm, wherein the oxygen transmission rate is calculated by the following equation:

$$O^2GTR=(E_e-E_0)Q/(AR)$$

where $O^2GTR$ is the oxygen transmission rate (cm$^3$/m$^2$·24 h·atm);

$E_e$ is the measured voltage (V);

$E_0$ is the base line voltage (V);

Q is a calibration constant;

A is the transmission area ($cm^2$); and

R is the load resistance (Ω).

6. A recording material according to claim 5, wherein the random copolymer formed by copolymerizing ethylene and vinyl alcohol has an ethylene content in the range of 20 to 60 mole percent and a degree of saponification of not less than 90 mole percent.

* * * * *